United States Patent [19]

Rossi

[11] Patent Number: 4,805,354

[45] Date of Patent: Feb. 21, 1989

[54] APPARATUS AND METHOD FOR LAPPING AN EDGE SURFACE OF AN OBJECT

[75] Inventor: Vito N. Rossi, Hamilton Township, Mercer County, N.J.

[73] Assignee: General Electric Company, Schenectady, N.Y.

[21] Appl. No.: 53,559

[22] Filed: May 21, 1987

Related U.S. Application Data

[63] Continuation of Ser. No. 860,446, May 7, 1986, abandoned.

[51] Int. Cl.[4] ..... B24B 1/00

[52] U.S. Cl. ..... 51/283 E; 51/277; 51/216 H

[58] Field of Search ..... 51/220, 221, 283 R, 51/283 E, 277, 156, 157, 161, 216 H, 216 P, 216 LP, 281 R, 229

[56] References Cited

U.S. PATENT DOCUMENTS

| | | | |
|---|---|---|---|
| 264,877 | 9/1882 | Heyer | 51/156 |
| 2,412,306 | 12/1946 | Stoll | 51/156 |
| 2,493,461 | 1/1950 | MacConnell | 51/283 |
| 2,635,398 | 4/1953 | Sohn | 51/216 P |
| 3,587,196 | 6/1971 | Dunn | 51/283 |
| 3,868,794 | 3/1975 | Zitkus | 51/283 |
| 4,519,168 | 5/1985 | Cesna | 51/216 LP |
| 4,625,460 | 12/1986 | Burgess et al. | 51/229 |

FOREIGN PATENT DOCUMENTS

| | | | |
|---|---|---|---|
| 52-52297 | 4/1977 | Japan | 51/216 R |
| 55-22820 | 2/1980 | Japan | 51/216 R |

OTHER PUBLICATIONS

"Metallorgraphic Mount With Optical Feedback"; W. E. Semple; IBM Technical Disclosure Bulletin; vol. 20, No. 10, Mar. 1978.

*Primary Examiner*—Frederick R. Schmidt
*Assistant Examiner*—Robert R. Rose
*Attorney, Agent, or Firm*—Henry I. Steckler; James C. Davis, Jr.; Paul R. Webb, II

[57] ABSTRACT

An apparatus for lapping an edge surface of an object comprises a block having a side adapted to engage a wide surface of an object, adjustable spacers disposed on the block and adapted to engage a lap plate, and a weighted spring disposed on the block for urging the spacers and the object edge surface towards the lap plate. A method for lapping comprises setting surfaces of adjustable spacers disposed on a block to be substantially the same distance from the block, affixing a wide surface of an object to the block, urging an edge surface of the object and the spacers towards a lap plate, lapping the edge of the object, inspecting the edge for parallelism to a reference line, resetting the spacers and relapping the edge surface.

9 Claims, 2 Drawing Sheets

APPARATUS AND METHOD FOR LAPPING AN EDGE SURFACE OF AN OBJECT

The invention described herein was made in the performance of work under NASA Contract No. NAS 5-27505 and is subject to the provisions of Section 305 of the National Aeronautics and Space Act of 1958, as amended (72 Stat. 435; U.S.C. 2457).

This is a continuation of application Ser. No. 860,446, filed on May 7, 1986, now abandoned.

BACKGROUND OF THE INVENTION

The present invention relates to an apparatus and method for lapping an object edge surface, and more particularly to such apparatus and a method that provide a lapped edge surface that is substantially parallel to a reference line on an integrated circuit (IC) wafer.

Solid state imagers are typically constructed in the form of an IC wafer. For some applications, such as imaging from an earth satellite, it is desired to have about four scanning lines, with each line having about 5000 to 6000 pixels (picture elements) to provide a large field of view with a high resolution. However, a wafer with such a large number of pixels per line is difficult to manufacture with an acceptably low number of defects. Thus wafers having four lines, each line having about 1000 pixels have been made, their edges lapped,and then five or six wafers joined together at the lapped edges to provide the desired 5000 to 6000 pixels per line.

However, these edges must be lapped parallel to the circuitry on the chip with a high degree of accuracy, typically two to five micrometers (μm) across a 0.38 centimeter (cm) wafer edge, so as to be able to be joined to other wafers and form a straightl line array with the spacing between adjacent pixels on adjacent wafers being the same as the spacing between adjacent pixels on the same wafer. Further, the lapping apparatus and method must not excessively chip (cut ) the IC wafer which can create a short circuit that renders the wafer inoperative.

It is therefore desirable to have a lapping apparatus and method that provides a highly accurate lap without excessively chipping the lapped object.

SUMMARY OF THE INVENTION

An apparatus for lapping an edge surface of an object comprises a block having a side adapted to engage a wide surfae of an object, adjustable spacers disposed on said block and adapted to engage a lap plate, and means disposed on said block for urging the spacers and the object edge towards the lap plate.

In accordance with the invention, a method for lapping comprises setting surfaces of adjustable spacers disposed on a block to be substantially the same distance from the block, affixing a wide surface of an object to said block, urging the spacers and an edge surface of said object towards a lap plate, lapping said edge surface, inspecting said edge surface for parallelism to a reference line, resetting said spacers, and relapping said edge surface.

DETAILED DESCRIPTION OF THE PREFERRED EMBODIMENTS

Figure 1:
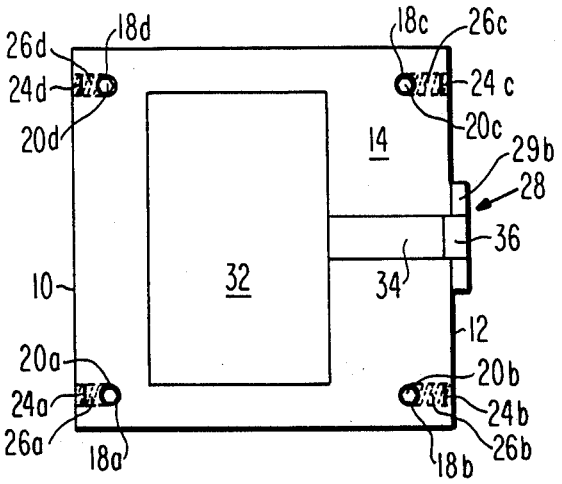
FIGS. 1 and 2 are top and side views, respectively, of apparatus of the invention.
Figure 2:
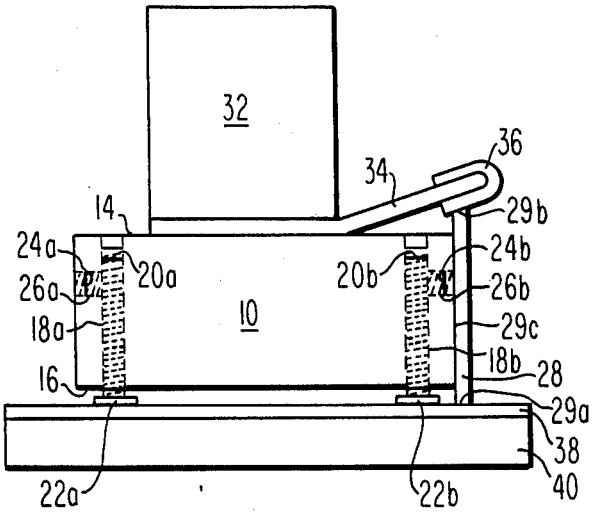

As shown in FIGS. 1 and 2, a block 10 has a polished sie surface 12 which is at an accurate right angle with respect to opposed flat and polished top surface 14 and bottom surface 16 threaed holes 18*a*, 18*b*, 18*c* and 18*d* in each corner thereof, respectively, which are parallel to the adjacent sides thereof. Adjustable spacers comprise threaded screws 20*a*, 20*b*, 20*c*, and 20*d*, and feet 22*a* and 22*b*. Each of the screws 20*a*, 20*b*, 20*c*, and 20*d* has an "Allen head" and polished flat bottom ends, and is disposed in one of the holes 18*a*, 18*b*, 18*c*, and 18*d*, respectively. The feet 22*a* and 22*b* are attached (as described below) to the screws 18*a* and 18*b*, respectively. Two additional feet (not shown) are are also a part of the adjustable spacers and are attached to the screws 18*c* and 18*d*, respectively. Set screws 24*a*, 24*b*, 24*c*, and 24*d* are disposed in threaded holes 26*a*, 26*b*, 26*c*, and 26*d*, respectively, and can have plastic ends (not shown) to avoid damaging the threads of the screws 20. An IC wafer 28 comprises opposing bottom and top edges 29*a* and 29*b*, respectively, and a wide surface 29*c*, which is disposed adjacent the side 12. By "edge surface" is meant any narrow surface of a thin, flat object such as the wafer 28.

A means for urging the wafer 28 towards a lap plate 42 inFIG. 3 comprises a weight 32 and a spring 34 having one end disposed under the weight 32 and another end engaging the top edge 29*b*. The weight 32 and the tension in the spring 34 are selected so that the same pressure is applied to each of the feet 22 and the bottom edge of the wafer 28. A cover 36 is over an end of the spring 34 to prevent damage to the top edge 29*b*. The entire structure described above is disposed on a sheet 38, which in turn is disposed ona plate 40 disposed on a heating means (not shown).

The block 10 can be a metal, such as cold rolled steel. The wafer 28 can comprise a semiconductor material such as Si, GaAs, InP, etc., and can alternately comprise a semiconductor on an insulator, such as glass. The feet 22 preferably comprise a material that has the same abrasion rate as that of the material of the wafer 28, e.g. they are of the same semiconductor as that of the wafer 28, to help ensure very nearly parallel lapping. Preferably, the feet 22 are all cut from the same wafer (distinct from the wafer 28) so that they will all have about the same thickness. The weight 32 can comprise brass, while the spring 34 can comprise spring steel. The cover 36 and the sheet 38 can comprise a plastic that does not wet with wax, such as the polyester polyethylene terephthalate, sold under the trademark "Mylar" or the E. I. Dupont DeNemours Co., Inc. The plate 40 can comprise glass.

Figure 3:
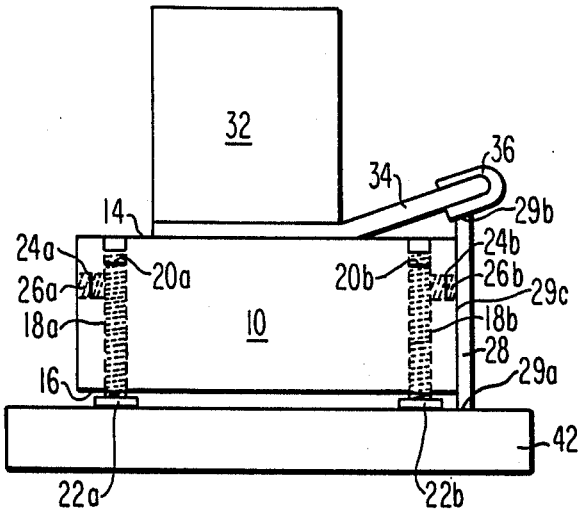
FIG. 3 is a side view of apparatus of the invention on a lap plate.

In operation, the feet 22 are mounted on the polished bottom ends of the screws 20 using an adhesive material, such as a combination rosin and beeswax called "quartz type sticky wax", made by Corning Rubber Co. Inc., Brooklyn, N.Y., having a first melting point such as 70° C. The screws 20 are then adjusted using a micrometer to measure from the top 14 to the bottom surface of the feet 22 until they protrude the same distance from the bottom 16 of the block 10 to within about ±15 μm. The set screws 24 are then turned to lamp the screws 20. The feet 22 are then lapped by hand using, e.g. a tin lap plate 42 (see FIG. 3) having 3 μm diamonds embedded therein, so that they project the same distance from the bottom 16 to within, e.g. ±2.5 μm, of each other.

The block 10, together with the feet 22, is then placed on the sheet 38 on the plate 40. The wide surface oif the wafer 28 is cleaned and placed against the side 12 of the block 10. The heating means (not shown) is then set to a temperature slightly less than the first melting point of the wax on the feet 22, e.g. less than 70° C., and another adhesive material, such as a combination wax comprising 50% of said sticky wax and 50% of pitch and pine tar called "Apiezon" sold by Arthur H. Thomas Co., Philadelphia, Pa., having a second melting pointless than the first melting point, e.g. less than 70° C., is placed on top of the block 10 near the side 12. This combination wax is drawn by capillary action between the side 12 and the wide surface **29*c* of the wafer 28 when the wafer 28 is ently pressed aainst the side 12 by, e.g. a rounded wooden probe. During this operation, the wax does not stick to the sheet 38 to any appreciable extent. The block 10, the wafer 28, the sheet 38, and the plate 40 are then removed from the heating means (not shown). The weight 32 and the spring 34 are then placed above the block 10 and the wafer 28. Since the same pressure is present at each of the feet 22 and the bottom edge 29*a* of the wafer 28, the sheet 38** will deform by the same amount thereunder, resulting in nearly parallel lapping and minimizing subsequent adjustments (described below). The resulting assembly is then allowed to cool.

A coating of sticky wax diluted in a solvent, such as 1.1.1 trichloroethane, is then applied to the wafer 28. The solvent then evaporates leaving a thin coating of sticky wax on the wafer 28, thereby protecting it during lapping (described below). The bottom edge **28*a* of the wafer 28 and the feet 22 are then lapped about 2 or 3 times using e.g. the 3 μm tin lap plate 42. The bottom edge 29*a* is then inspected using a microscope to see if it is being lapped parallel to an existing conductor on the wafer 28 that is used as a reference line and is perpendicular to the line scan direction. If no such conductor is normally present for a particular type of wafer, then the wafer can be made with such an added reference line. If the waer is not being lapped parallel to the reference line, then the projection distance of selected ones of feet 22 is adjusted. The lapping, inspection, and adjusting steps are repeated as often as needed to ensure substantially parallel lapping. Then a fine lapping is done using, e.g., a 1 μm tin lap plate, and finished using, e.g. a 0.25 μm tin lap plate. The wafer 28** is then unmounted by heating the wax, and then cleaned using a solvent to dissolve the waxes.

The same procedure is then used for lapping the top edge **29*b* with the possible exception of when the wafer 28** is to be used as an end wafer in an array of wafers.

EXAMPLE NO. 1

An imager wafer 28 comprising Si with an edge length of 0.38 cm was lapped using Si feet 22 and using the apparatus and method as described above. The resulting edge was parallel to the reference line to within about 2 μm.

EXAMPLE NO. 2

An imager wafer 28 comprising silicon-on-glass with an edge length of 0.38 cm was lapped using Si feet 22 using the apparatus and method as described above. The resulting edge was parallel to the reference line to within about 5 μm.

COUNTER EXAMPLE

In contradistinction, an imager wafer of Si with an edge length of 0.38 cm was lapped using an apparatus similar to that of the invention but with fixed. (non-adjustable) feet and without the weight 32 and the spring 34. The resulting edge was parallel to the reference line only to within about 25 μm. The amount of chipping was about the same as in Examples Nos. 1 and 2.

Thus the invention provides at least about a five times more nearly parallel lapping without any increase in chipping. This allows lapping closer to the circuitry of the wafer so that the spacing between adjacent pixels on adjacent wafers can be about the same as the spacings between adjacent pixels on the same wafer.

It will be appreciated that the present invention can be used to lap edges of objects other than semiconductor IC wafers.

What is claimed is:

1. An apparatus fo acurately lapping an edge surface of a thin flat object having wide and edge surfaces, said apparatus comprising:

a block having an outer side adapted to directly engage the wide surface of the object;

adjustable spacers disposed on a different side of said block having an abrasion rate the same as the object and adapted to engage a lap plate; and means disposed on said block for urging the spacers and the object edge surface towards the lap plate with equal pressure wherein said means for urging comprises a spring disposed on said block and having an end adapted to engage an opposing edge of said object, and weight disposed on said spring, the weight and tension of the spring being selected such that the same pressure is applied to each of the spacers and the bottom edge of the object.

2. The apparatus of claim 1 wherein said adjustable spacers comprise threaded screws disposed in threaded holes of said block and feet disposed on the ends of said screws.

3. The apparatus of claim 2 wherein said feet have the same abrasion rate as said object.

4. The apparatus of claim 3 wherein said feet comprise the same material as said object.

5. A method for accurately lapping an edge surface of a thin flat object said object having wide and edge surfaces, said method comprising:

setting surfaces of adjustable spacers having the same abrasion rate as the object and disposed on a side of a block to be substantially the same distance from the block;

affixing the wide surface of the object directly to an outer different side of said block;

urging said spacers and the edge surface of said object towards a lap plate with equal pressure wherein said step of urging comprises placing a spring on said block and on an opposing edge surface of said object, and placing a weight on said spring, the weight and tension of the spring being selected such that the same pressure is appl ied to each of the spacers and the bottom edge of the object;

lapping said edge surface of said object:

inspecting said edge for parallelism to a reference line;

resetting said spacers; and relapping said edge surface.

6. The method of claim 5 wherein said setting step comprises affixing feet to the ends of threaded scres disposed in said block and adjusting said screws so that surfaces of said feet are substantially the same distance from said block.

7. The method of claim 6 wherein said step of affixing said feet to said screws comprises bonding said screws and said feet using an adhesive material having a first melting point.

8. The method of claim 7 wherein said step of affixing said object to said block comprises bonding said object using an adhesive material having a second melting point lower than said first melting point.

9. The method of claim 5 wherein said step of affixing said object to said block comprises bonding said object using an adhesive material.

* * * * *